US011689874B2

(12) United States Patent
Pallone et al.

(10) Patent No.: US 11,689,874 B2
(45) Date of Patent: Jun. 27, 2023

(54) CALIBRATION OF A DISTRIBUTED SOUND REPRODUCTION SYSTEM

(71) Applicant: ORANGE, Issy-les-Moulineaux (FR)

(72) Inventors: Grégory Pallone, Chatillon (FR); Marc Emerit, Chatillon (FR); Stéphane Louis Dit Picard, Chatillon (FR); Thomas Joubaud, Chatillon (FR)

(73) Assignee: ORANGE, Issy-les Moulineaux (FR)

( * ) Notice: Subject to any disclaimer, the term of this patent is extended or adjusted under 35 U.S.C. 154(b) by 0 days.

(21) Appl. No.: 17/415,302

(22) PCT Filed: Dec. 9, 2019

(86) PCT No.: PCT/FR2019/052961
§ 371 (c)(1),
(2) Date: Jun. 17, 2021

(87) PCT Pub. No.: WO2020/128214
PCT Pub. Date: Jun. 25, 2020

(65) Prior Publication Data

US 2022/0060840 A1 Feb. 24, 2022

(30) Foreign Application Priority Data

Dec. 21, 2018 (FR) ..... 1873726

(51) Int. Cl.
*H04S 7/00* (2006.01)
*H04R 3/12* (2006.01)

(52) U.S. Cl.
CPC ..... *H04S 7/301* (2013.01); *H04R 3/12* (2013.01); *H04S 2400/01* (2013.01)

(58) Field of Classification Search
CPC ..... H04S 7/301
See application file for complete search history.

(56) References Cited

U.S. PATENT DOCUMENTS 9,472,203 B1 10/2016 Ayrapetian et al.
2014/0153744 A1 6/2014 Brannmark et al.

FOREIGN PATENT DOCUMENTS

WO 2014040667 A1 3/2014

OTHER PUBLICATIONS

ITU standard entitled "Multichannel stereophonic sound system with and without accompanying picture" from ITUR BS.775-3, Radiocommunication Sector of ITU, Broadcasting service (sound), published in 2012.

(Continued)

*Primary Examiner* — Ping Lee
(74) *Attorney, Agent, or Firm* — David D. Brush; Westman, Champlin & Koehler, P.A.

(57) ABSTRACT

A method for calibrating a distributed audio reproduction system, including a set of N heterogeneous loudspeakers controlled by a server. This method includes the following steps: a) placing a microphone in front of a first loudspeaker of the set; b) capturing), by the microphone, a calibration signal sent to the loudspeaker at a first time and reproduced by same; c) capturing, by the microphone, the calibration signal sent with a known time delay to the N−1 other loudspeakers of the set and reproduced by these N−1 loudspeakers; d) capturing, by the microphone, the calibration signal sent to the first loudspeaker at a second time and reproduced again by same; e) repeating steps a) to d) for the N loudspeakers of the set; f) determining a plurality of heterogeneity factors to be corrected for the set of N loudspeakers by analysing the data thus captured; g) correcting the determined heterogeneity factors.

15 Claims, 4 Drawing Sheets

(56) References Cited

OTHER PUBLICATIONS

IEEE standard entitled, "Standard for a precision clock synchronization protocol for networked measurement and control systems", published by IEEE Instrumentation and Measurement Society IEEE, 1588-2008, Approved Nov. 7, 2019.
Oppenheim, A. V. et al., "Discrete-Time Signal Processing", published in Prentice Hall, second edition, 1999, Part 1.
Oppenheim, A. V. et al., "Discrete-Time Signal Processing", published in Prentice Hall, second edition, 1999, Part 2.
Parhizkar, R., "Euclidean Distance Matrices: Properties, Algorithms and Applications", published in PhD thesis, Ecole Polytechnique Federale de Lausanne (Swiss Federal Institute of Technology Lausanne), Switzerland in 2013.
International Standard, "Information technology—High efficiency coding and media delivery in heterogeneous environments—Part 3: 3D audio", ISO/IEC 23008-3:201x(E), Oct. 10, 2016.
Dokmanic, I. et al., "Euclidean distance matrices: Essential theory, algorithms, and applications", published in IEEE Signal Processing Magazine, 32(6): 12-30, Oct. 13, 2015.
International Search Report dated Mar. 23, 2020 for corresponding International Application No. PCT/FR2019/052961, Dec. 9, 2019.
Written Opinion of the International Searching Authority dated Mar. 23, 2020 for corresponding International Application No. PCT/FR2019/052961, filed Dec. 9, 2019.
English translation of the Written Opinion of the International Searching Authority dated Mar. 31, 2020 for corresponding International Application No. PCT/FR2019/052961, filed Dec. 9, 2019.

CALIBRATION OF A DISTRIBUTED SOUND REPRODUCTION SYSTEM

CROSS-REFERENCE TO RELATED APPLICATIONS

This Application is a Section 371 National Stage Application of International Application No. PCT/FR2019/052961, filed Dec. 9, 2019, the content of which is incorporated herein by reference in its entirety, and published as WO 2020/128214 on Jun. 25, 2020, not in English.

FIELD OF THE DISCLOSURE

The present invention relates to the field of audio rendering in a distributed and heterogeneous audio rendering system.

More particularly, the present invention relates to a method and system for calibrating an audio rendering system comprising a plurality of heterogeneous speakers or sound rendering elements.

BACKGROUND OF THE DISCLOSURE

The term "heterogeneous speakers" is understood to mean speakers which come from different suppliers and/or which are of different types, for example wired or wireless. In such a heterogeneous distributed context, where wired and wireless speakers, of different makes and models, are networked and controlled by a server, obtaining a coherent listening system which makes it possible to listen to a complete soundstage or to broadcast the same audio signal simultaneously in several rooms of the same house is not easy.

Indeed, several heterogeneity factors may arise. The various wireless speakers have their own clock. This situation creates a lack of coordination between the speakers. This lack of coordination includes both a lack of synchronization between the clocks of the speakers, i.e. the speakers do not start to "play" at the same time, and a lack of tuning, i.e. the speakers do not "play" at the same rate.

A lack of synchronization may result in an audible delay and/or a shift in the spatial image between the devices. A lack of tuning may result in a comb filter variation effect, an unstable spatial image, and/or audible clicks due to sample starvation or overload.

Another heterogeneity factor may arise from the fact that the different speakers may have different sound renderings. First of all, from an overall point of view, since some speakers are not on the same sound card and others are wireless speakers, they probably do not play at the same volume. In addition, each speaker has its own frequency response, thus meaning that the rendering of each frequency component of the signal to be played is not the same.

Yet another heterogeneity factor may lie in the spatial configuration of the speakers. In the case of a multichannel rendering, the speakers are generally not ideally positioned, i.e. their positions relative to one another do not follow standardized positions for obtaining optimal listening at a given position of a listener. For example, the ITU standard entitled "Multichannel stereophonic sound system with and without accompanying picture" from ITU-R BS.775-3, Radiocommunication Sector of ITU, Broadcasting service (sound), published in 2012 describes such a positioning of speakers for multichannel stereophonic systems.

There are various systems or protocols allowing only some heterogeneity factors to be corrected, and independently.

Conventional multichannel listening systems control various speakers from a single sound card, so these systems do not experience synchronization issues. Synchronization issues appear as soon as a plurality of sound cards are present or wireless speakers are used. In this case, the synchronization issue stems from a latency issue between the speakers.

Manufacturers of wireless speakers are able to address this issue by applying a network synchronization protocol between their products which of course come from the same manufacturer, but this is no longer possible in the case of heterogeneous distributed audio where the speakers come from different manufacturers.

Another solution consists in finding the latency between the speakers using electroacoustic measurement. If the same signal is sent at the same time to all of the speakers of a distributed audio system, each of them will play it at a different time. Measuring the differences between these times gives the relative latencies between the speakers. Synchronizing the speakers therefore means delaying those which are furthest ahead from the estimated values. This technique has already been applied to synchronize Bluetooth speakers of different makes and models. However, it does not take into account the clock drift that exists between the speakers. Thus, the speakers may appear to play at the same time at the start of playback but will fall out of sync over time.

Other techniques make it possible to reduce defects of sound rendering level or speaker position type, but this requires independent measures linked to each defect capable of being corrected.

SUMMARY

An exemplary embodiment of the present invention aims to improve the situation.

To that end, an exemplary embodiment of the invention relates to a method for calibrating a distributed audio rendering system, comprising a set of N heterogeneous speakers controlled by a server. The method is such that it comprises the following steps:

a) placing a microphone in front of a first speaker of the set;

b) capturing, by means of the microphone, a calibration signal sent to the first speaker at a first time and rendered by this speaker;

c) capturing, by means of the microphone, the calibration signal sent with a known time shift to the N−1 other speakers of the set and rendered by these N−1 speakers;

d) capturing, by means of the microphone, the calibration signal sent to the first speaker at a second time and rendered again by this speaker;

e) iterating steps a) to d) for the N speakers of the set;

f) determining a plurality of heterogeneity factors to be corrected for the set of the N speakers by analyzing the data thus captured;

g) correcting the determined heterogeneity factors.

The calibration process thus described makes it possible to optimize capture for various heterogeneous speakers which do not necessarily belong to the same supplier or which are of different types in order to obtain corrections adapted to the various heterogeneity factors of the speakers of the rendering system. A single calibration process makes it possible to correct various heterogeneity factors, which both allows the quality of the distributed system to be improved and the resources required for the calibration of this system to be optimized. Steps b), c) and d) of this method may be carried out in a different order without this adversely affecting the scope of the invention.

The various particular embodiments mentioned hereinafter may be added independently or in combination with one another to the steps of the calibration method defined above. Various heterogeneity factors are possible such as a synchronization, a tuning of the speakers forming the coordination of these speakers, a sound volume of the speakers, a sound rendering of the speakers and/or a mapping of the speakers.

These various heterogeneous factors need to be corrected at least in part. All of these factors may be corrected by the same calibration method.

In one particular embodiment, the microphone is in a calibration device previously tuned with the server.

Thus, it is possible to use, for example, a terminal equipped with a microphone to carry out the capture steps. Since this calibration device is at the same rate as the server, it is then possible to correct the heterogeneity factors of the various speakers in an appropriate manner with respect to the server that controls them and by virtue of the captured data.

In one embodiment, the analysis of the captured data comprises multiple detections of peaks in a signal resulting from a convolution of the captured data with an inverse calibration signal, a maximum peak being detected by taking into account an exceedance threshold for the detected peak and a minimum duration between two detected peaks, in order to obtain N(N+1) timestamp data.

The convolution of the captured data with the inverse calibration signal gives the impulse responses of the various speakers during the capture according to the described method. The detection of the peaks therefore makes it possible to find the timestamp data for these impulse responses.

According to one advantageous embodiment, an upsampling is implemented on the captured data before the detection of peaks. This upsampling makes it possible to have more precise detection of peaks, which refines the timestamp data determined on the basis of this detection of peaks and will make it possible to increase the precision of the estimated drifts.

In one particular embodiment, an estimate of a clock drift of a speaker of the set with respect to a clock of the processing server is made on the basis of the timestamp data obtained for the calibration signals sent at the first and at the second time and of the time elapsed between these two times.

The calculation of this clock drift makes it possible to determine the heterogeneity factor relating to the tuning of the speakers which may then be corrected in order to homogenize the rendering system.

To supplement this estimate of drift, in one embodiment, an estimate of the relative latency between the speakers of the set, taken in pairs, is made on the basis of the obtained timestamp data and the estimated drifts.

The calculation of these latencies makes it possible to determine the heterogeneity factor relating to the synchronization of the various speakers which may then be corrected in order to homogenize the rendering system.

On the basis of this latency estimate, it is possible, according to one embodiment, to estimate the distance between the speakers of the set, taken in pairs, on the basis of the obtained timestamp data, the estimated relative latencies and the estimated drifts.

The estimation of these distances makes it possible to determine the heterogeneity factor relating to the mapping of the speakers in the rendering system which may be corrected in order to homogenize it.

According to one embodiment of the invention, a heterogeneity factor relating to a tuning of the speakers of the set is corrected by resampling the audio signals intended for the corresponding speakers, according to a frequency dependent on the estimated clock drifts of the speakers with the clock of the server.

This type of correction thus makes it possible to correct the clock drifts of the speakers without modifying the clock of their respective client.

According to one embodiment, a heterogeneity factor relating to a synchronization of the speakers of the set is corrected by adding a buffer, for the transmission of the audio signals intended for the corresponding speakers, the duration of which is dependent on the estimated latencies of the speakers. Similarly, this type of correction makes it possible to correct the relative latencies between the speakers without modifying the clocks of the respective clients.

According to one particular embodiment, a heterogeneity factor relating to the sound rendering and/or a heterogeneity factor relating to the sound volume of the speakers of the set is corrected by equalizing the audio signals intended for the corresponding speakers, according to gains dependent on the captured impulse responses of the speakers.

Thus, the correction made to the audio signals makes it possible to easily adapt the sound rendering and/or the sound volume. A plurality of heterogeneity factors may thus be corrected via one and the same calibration method.

In one particular embodiment, a heterogeneity factor relating to a mapping of the speakers of the set is corrected by applying a spatial correction to the corresponding speakers, according to at least one delay dependent on the estimated distances between the speakers and a given position of a listener.

Another heterogeneity factor is thus corrected on the basis of these same collected data and estimated distances between the speakers.

The present invention also relates to a system for calibrating a distributed audio rendering system, comprising a set of N heterogeneous speakers controlled by a server. The calibration system comprises:

- a microphone which, placed in front of a first speaker of the set, is able to capture a calibration signal sent to the first speaker at a first time and rendered by this speaker, to capture the calibration signal sent with a known time shift to the N−1 other speakers of the set and rendered by these N−1 speakers, to capture the calibration signal sent to the first speaker at a second time and rendered by this speaker and to iterate the capture operations for the N speakers of the set, and
- a processing server comprising a module for collecting the captured data, an analysis module able to analyze the captured and collected data in order to determine a plurality of heterogeneity factors to be corrected and a correction module able to calculate the corrections for the determined heterogeneity factors and to transmit them to the various client modules of the corresponding speakers in order to apply the calculated corrections.

In one particular embodiment, the microphone is integrated into a terminal.

This calibration system exhibits the same advantages as the method described previously, that it implements.

The invention targets a computer program including code instructions for implementing the steps of the calibration method as described when these instructions are executed by a processor.

The invention relates lastly to a storage medium, able to be read by a processor, which is integrated or not integrated into the calibration system and potentially removable, on which there is recorded a computer program comprising code instructions for executing the steps of the calibration method as described above.

BRIEF DESCRIPTION OF THE DRAWINGS

Other features and advantages of the invention will become more clearly apparent from reading the following description, given purely by way of non-limiting example and with reference to the appended drawings, in which.

DETAILED DESCRIPTION OF ILLUSTRATIVE EMBODIMENTS

Figure 1:
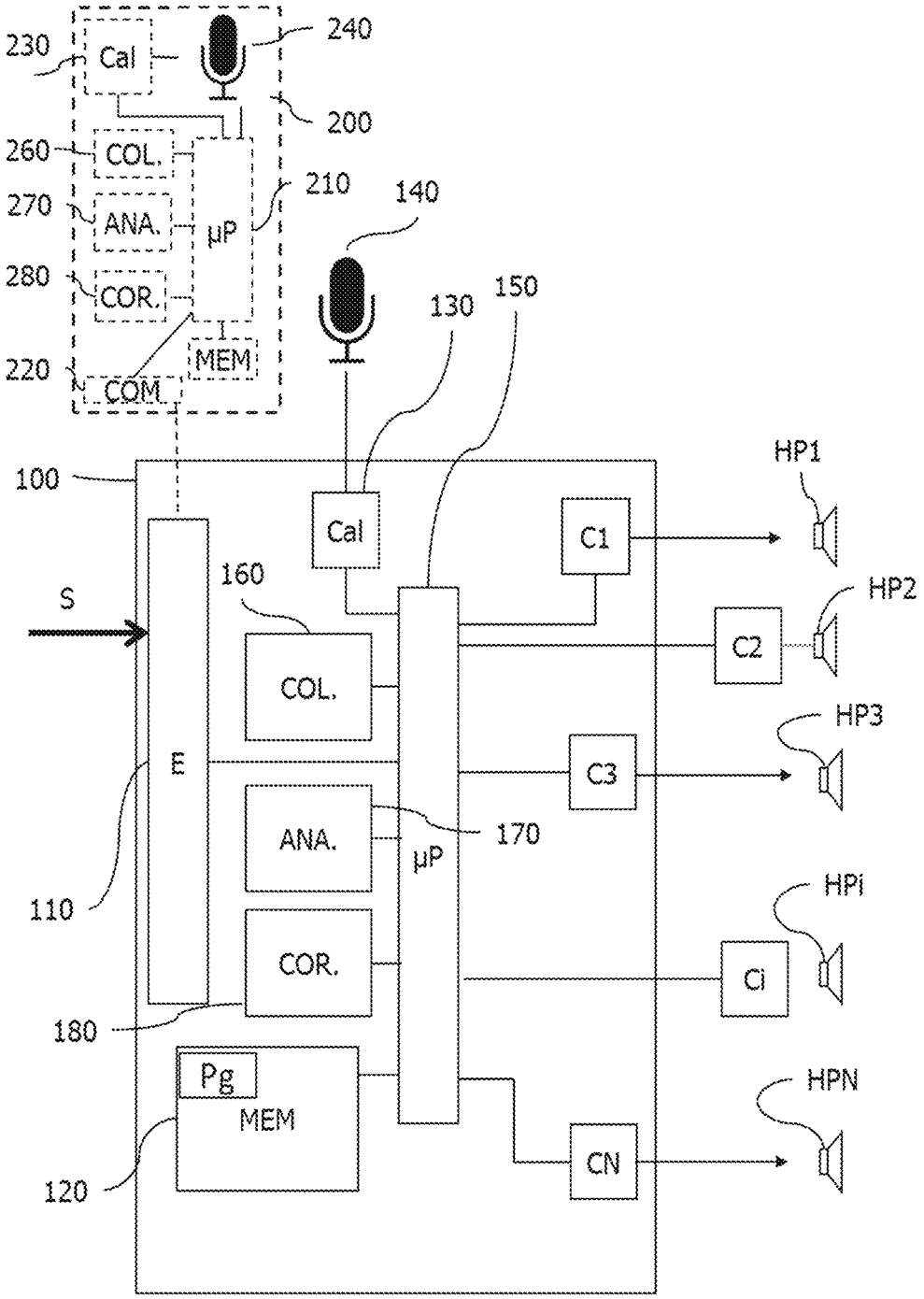
FIG. 1 illustrates a calibration system comprising a plurality of heterogeneous speakers, a server and a microphone for implementing the calibration method according to one embodiment of the invention.

Thus, FIG. 1 shows a calibration system according to one embodiment of the invention. This system comprises a set of N heterogeneous speakers HP1, HP2, HP3, . . . , HPi . . . , HPN. In the example illustrated here, the speakers come from different suppliers, some are connected to a sound card by wire, others are connected via a wireless transmission system. For example, the speaker represented by HP1 is a Bluetooth Speaker® from any manufacturer, the speaker represented by HPN is also a Bluetooth Speaker® from another manufacturer.

The speaker represented by HP3 is, for example, a speaker using "Apple Airplay®" technology to connect wirelessly to a broadcast server.

Other speakers of the overall rendering system are connected by wire to devices which may be different and have different sound cards. For example, the speaker represented by HP2 is connected to a living room audio-video decoder, of "set-top box" type, the speaker HPi is connected to a personal computer. Of course, this configuration is only one example of a possible configuration, many other types of configuration are possible and the number N of speakers is variable.

All of these speakers in this set are therefore heterogeneous; they each have their own clock. Each sound card or wireless speaker is controlled by a software module called the client module represented here by C1, C2, C3, . . . , Ci, . . . , CN. These client modules are themselves connected to a processing server of a local network represented by 100. This local network server may be a personal computer, a compact computer of "Raspberry Pi®" type, an audio-video amplifier ("AVR" for audio-video receiver), a home gateway serving both as an external network access point and as a local network server, a communication terminal. The server 100 and the client modules may be integrated into the same device or distributed over a plurality of devices in the house. For example, the client module C1 of the speaker HP1 is integrated into the server 100 while the client module C2 of the speaker HP2 is integrated into a TV decoder controlled by the server 100.

The server 100 comprises a processing module 150 comprising a processor μP for controlling the interactions between the various modules of the server and cooperating with a memory block 120 (MEM) comprising a storage and/or working memory. The memory module 120 stores a computer program (Pg) comprising instructions for executing, when these instructions are executed by the processor, steps of the calibration method as described, for example, with reference to FIGS. 4 and 5. The computer program may also be stored on a memory medium that can be read by a reader of the server device or that can be downloaded into the memory space thereof.

This server 100 comprises an input or communication module 110 able to receive audio data S originating from various audio sources, whether local or from a communication network.

The processing module 150 then sends, to the client modules C1 to CN, the received audio data, in the form of RTP (for "Real-Time Protocol") packets. In order for these audio data to be rendered by the set of speakers in a homogeneous manner, i.e. so that they constitute a homogeneous and audible soundstage between the various speakers, the client modules have to be able to control their speakers without them having uncorrected heterogeneity factors between them. For example, the various clients C1 to CN have to be both synchronized and tuned with the server. An explanation of these two terms is described later with reference to FIG. 2.

The calibration system presented in FIG. 1 comprises at least one microphone 140 connected to a client control module (CAL) 130 which may be integrated into the server as shown here. In this case, the microphone may be connected by wire to the server. The client control module of the microphone and the server then share the same clock. This client module is then naturally tuned with the server.

In another embodiment, a microphone 240 is integrated into a calibration device 200 comprising the microphone control module 230, a processing module 210 comprising a microprocessor and a memory MEM. Such a calibration device also comprises a communication module 220 able to communicate data to the server 100. This calibration device may for example be a communication terminal of smartphone type.

In this embodiment, the calibration device has its own sound card and its own clock. Tuning is then to be provided so that the calibration device and the server have the same clock rate and so that the capture of the data and the corrections to be made to the speakers are consistent with the clock of the server. For this, it is possible to implement a network synchronization protocol of PTP (for "Precision Time Protocol") type and as described for example in the IEEE standard entitled "*Standard for a precision clock synchronization protocol for networked measurement and control systems*", published by IEEE Instrumentation and Measurement Society IEEE 1588-2008.

Figure 4:
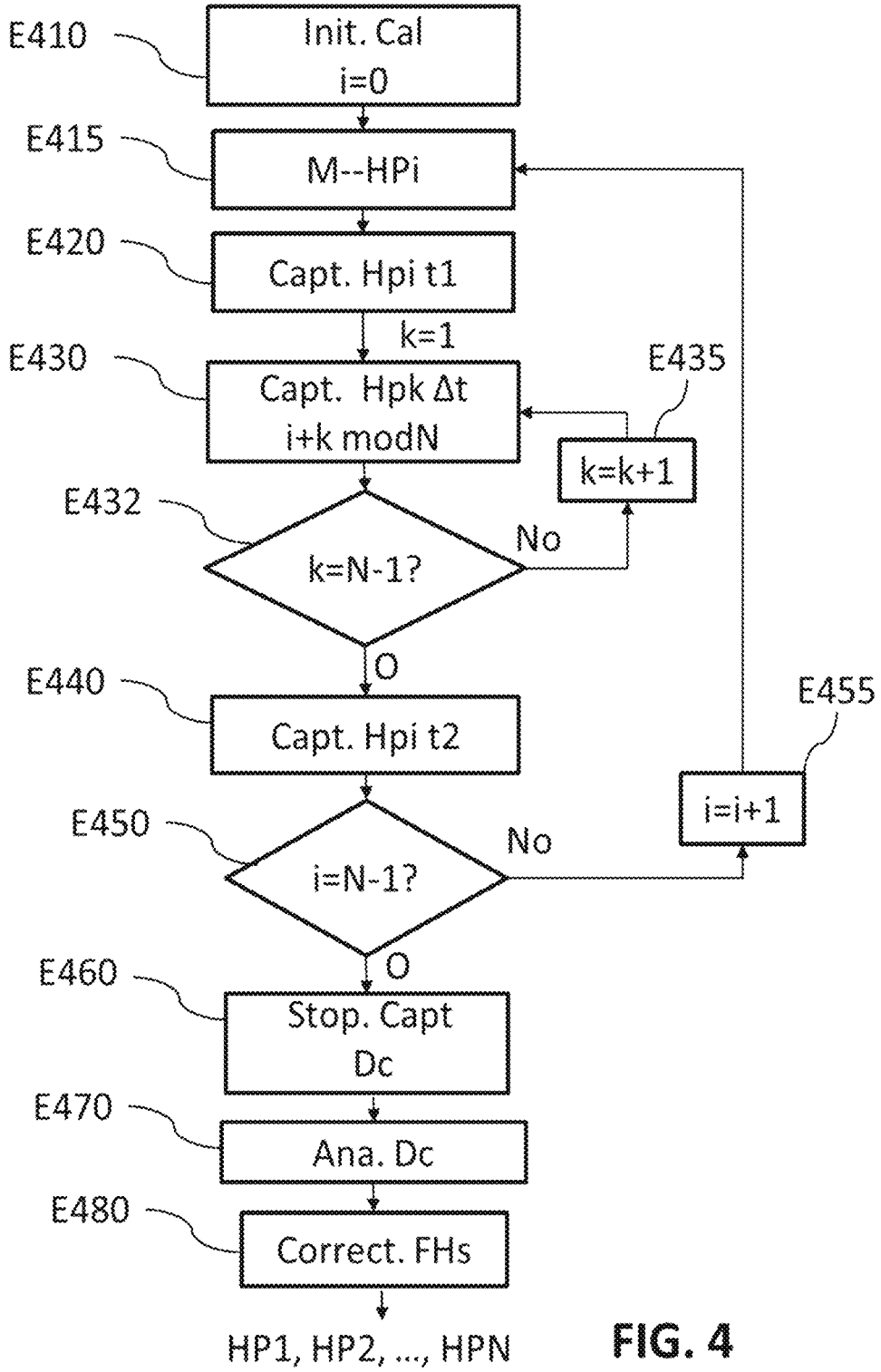
FIG. 4 illustrates a flowchart showing the main steps of a calibration method according to one embodiment of the invention.

To implement the calibration method according to the invention, the microphone is placed in front of the speakers of the set of speakers of the rendering system according to a calibration method described below. A calibration signal as described later with reference to FIG. 4 is sent by the processing server 100 to the various speakers of the system and at different times according to the capture procedure described later with reference to FIG. 4.

All of the data captured by this microphone and following this calibration procedure are collected, for example, by the collection module 160 of the server which memorizes the captured signals and the timestamp information determined after analysis of the rendered signals and the various times of sending of the calibration signals to the various speakers.

These captured and recorded data are analyzed by the analysis module 170 of the server 100 in order to determine a plurality of heterogeneity factors to be corrected on the various speakers. Corrections for these various heterogeneity factors are then determined by the correction module 180 which calculates the sampling frequencies, buffer duration, gains or other parameters to be applied to the speakers in order to make the system homogeneous.

These various parameters are then sent to the various client modules so that the appropriate correction is made to the corresponding speakers.

In the case where the microphone is integrated into a calibration device 200, this device may also comprise a collection module 260 which collects the captured data and sends them to the server via the communication module 220. This calibration device may also integrate an analysis module 270 which, in the same way as described above for the server, analyzes the collected data in order to determine a plurality of heterogeneity factors to be corrected. The calibration device may send these heterogeneity factors to the server via its communication module 220 or else determine the corrections to be made itself if it integrates a correction module 270. In this case, it sends the server the corrections which are to be applied to the speakers via their respective client module.

Thus, when the calibration method is carried out, the rendering system has become homogeneous, i.e. the various heterogeneity factors of the speakers of the set have been corrected. The various speakers are then, for example, synchronized, tuned, they have homogeneous sound rendering and sound volume. Their spatial rendering may be corrected so that the soundstage rendered by this rendering system is optimal with respect to the given position of a listener.

A definition of the terms "synchronization" and "tuning" of the clocks of the various speakers is now presented. Two independently operating devices have their own clock. A clock is defined as a monotonic function equal to a time which increases at the rate determined by the dock frequency. It generally starts when the device is started up.

The clocks of two devices are necessarily different and three parameters are defined:

clock offset: time difference at start between two clocks;

clock drift: frequency difference between two clocks;

clock deviation: variation in the drift over time, or second derivative of the clock with respect to time.

Figure 2:
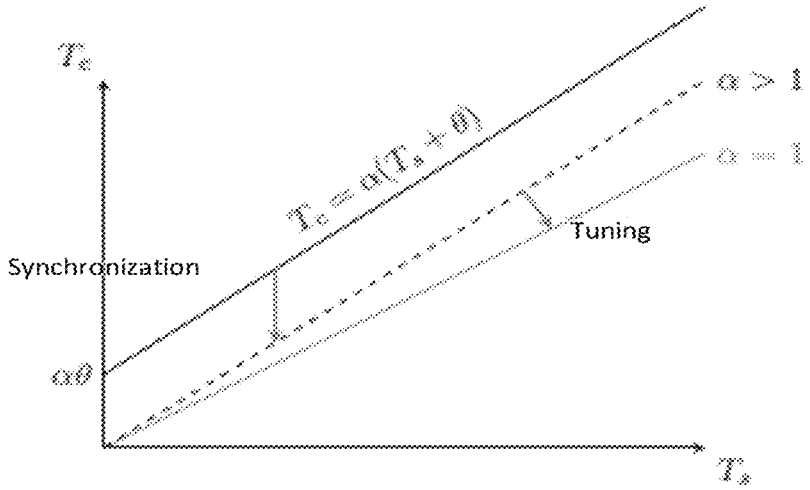
FIG. 2 illustrates a clock model and the heterogeneity factors relating to synchronization and tuning according to one embodiment of the invention.

Conventional modeling of a clock ignores clock deviation, which is mainly caused by changes in temperature. Thus, in a server/client network context, the clock of the client Tc is expressed according to the clock of the server Ts according to the equation (EQ1): $Tc=\alpha(Ts+\theta)$ where a represents the clock drift of the client with respect to that of the server, and $\theta$ represents the offset of the clock of the client. FIG. 2 shows this model.

The offset is a time and is expressed in seconds. The drift is a dimensionless value equal to the ratio of the clock frequencies of the server and of the client fs/fc. It is usually given in the form of a value as ppm (parts per million) produced by calculating (EQ2):

$$10^6\left(1-\frac{f_s}{f_c}\right).$$

In an audio context, the drift may be found on the basis of the sampling frequencies. FIG. 2 introduces the problem of clock coordination: for the client to have the same clock as the server, its drift $\alpha$ and its shift $\theta$ have to be corrected. The first operation results in the tuning of the client and of the server, while the second results in their synchronization.

The calibration method implemented by the calibration system described above with reference to FIG. 1 is now described with reference to FIG. 4. The system is described here when calibration is planned for N speakers.

A first step E410 of initiating capture is implemented by initializing the number of speakers taken into account at 0 (i=0).

In step E415, the capture microphone of the calibration device is placed in front of a first speaker (HPi) of the rendering system which therefore comprises N speakers.

In step E420, a calibration signal is sent, at a first time t1, to the speaker HPi by the server via the client module Ci of the speaker HPi. The rendering of this signal is captured by the microphone in this step E420.

The calibration signal is, for example, a signal the frequency of which increases logarithmically with time, this signal being called logarithmic "sweeps" or "chirps".

The convolution of the signal measured at the output of the speaker with an inverse calibration signal makes it possible to obtain the impulse response of the speaker directly. Such a signal is, for example, an exponential sliding sine-type signal as illustrated with reference to FIG. 3, ESS of length T (0.2 s in the example illustrated in FIG. 3) and going from the frequency f1 (20 Hz) to f2 (20 kHz). This signal is written as follows as a function of time t as follows (EQ3):

$$ESS(t)=\sin\left[\frac{2\pi f1T}{\ln\left(\frac{f2}{f1}\right)}\left(e^{\frac{t}{T}\ln\left(\frac{f2}{f1}\right)}-1\right)\right]$$

The measurement of this signal played by a speaker makes it possible to estimate its impulse response by calculating the cross-correlation between the measured signal and the theoretical signal ESS(t). This is achieved in practice by convolving the measured signal with an inverse sliding sine iESS exhibiting an exponential decay in order to compensate for the differences in energy between the frequencies (EQ4):

$$iESS(t)=ESS(T-t)e^{-t\frac{\ln\left(\frac{f2}{f1}\right)}{T}}$$

Figure 3:
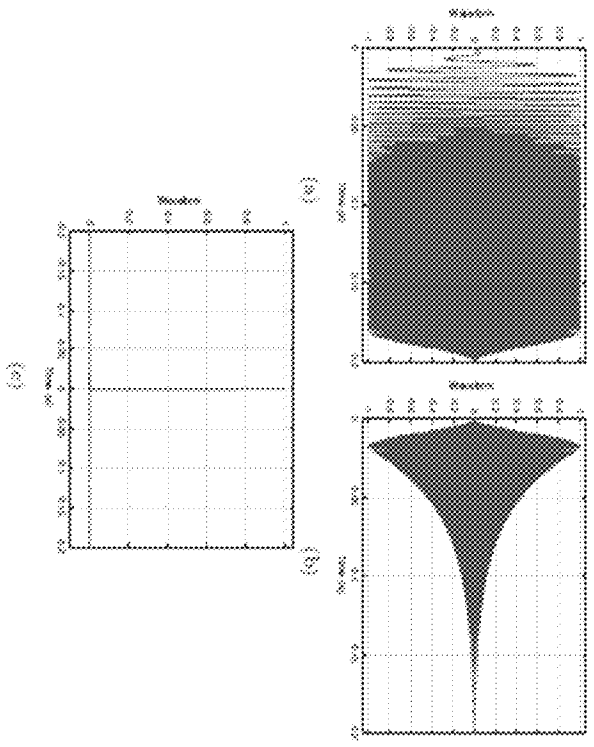
FIG. 3 illustrates an exemplary calibration signal used to implement the calibration method according to one embodiment of the invention.

FIG. 3 presents such an example of a calibration signal, graph (a) shows an exponential sliding sine of 0.2 s, graph (b) the inverse signal and graph (c) the impulse response obtained by convolving the sliding sine by its inverse.

In steps E430, E432 and E435 of FIG. 4, the calibration signal is sent to the speakers of the set of speakers, HPk, with k ranging from 1 to N−1 and different from i. This signal is sent to each of the speakers via its client module Ck with a known time shift Δt which may be, for example, 5 s.

This time shift is memorized in the server. It may be equivalent between each of the speakers or different. The rendering of these signals is captured in this step E430 by the microphone which is still in front of the speaker HPi.

The order in which the calibration signal is sent to these various speakers may be pre-established by the server. For example, in the embodiment illustrated in steps E430 to E435 of FIG. 4, if the microphone is in front of speaker i, the server sends a calibration signal to the speaker i+1 and then to the speaker i+2, . . . , to the speaker i+k modulo N until all of the speakers other than i have been taken into account. It performs this same sequence for each change in position of the microphone.

Another pre-established order may be, for example, to start sending the calibration signal always by starting at the same speaker other than i according to a defined order and sequence (to the next speaker if equal to the microphone positioning speaker).

These pre-established orders are known to the server and to the analysis module in order to know to which speaker a captured datum corresponds.

Lastly, the server may send the calibration signal in a random order to the speakers other than i but, in this case, the identification of the speaker for which the calibration signal is sent has to be given in association with the captured datum so that the analysis of the collected data is relevant.

In step E440, the calibration signal is played again by the speaker HPi, at a time t2 different from t1, which may be at a time shift Δt from the last speaker of the loop E430 to E435 or else a time shifted by t1 and before the implementation of the loop E430 to E435.

The duration separating the time t2 from the time t1 is memorized in the memory of the processing server.

In step E440, it is checked whether the loop E415 to E455 is finished, i.e. all of the speakers have been processed in the same way. If this is not the case (N in E450), then steps E415 to E440 are iterated for the next speaker i, i ranging from 0 to N−1. The order of passage of the speakers is the same for the loop E430 to E435 for each iteration. When all of the speakers have been processed by the loop E415 to E440 (O in E450), step E460 is implemented.

Steps E420 to E440 may be carried out in a different order. For example, the capture of the calibration signal sent at times t and t2 to the same speaker i may be performed before the capture of the signals rendered by the other speakers. It is also possible to capture the signals rendered by the speakers other than i before capturing the signal rendered at times t and t2 by the speaker i. The order of these steps does not matter as far as the result of the method is concerned.

In step E460, the capture by the microphone is stopped and the captured data (Dc) are collected and recorded in a memory of the server or of the calibration device depending on the embodiment. These data are taken into account in the analysis step E470. This analysis step makes it possible to determine a plurality of heterogeneity factors to be corrected for all of the N speakers. These heterogeneity factors form part of a list from among:

- a clock coordination of the speakers comprising a synchronization and a tuning of the speakers;
- a sound volume of the speakers;
- a sound rendering of the speakers; and
- a mapping of the speakers.

A correction suitable for the determined heterogeneity factors is then determined and applied in E480.

Figure 5:
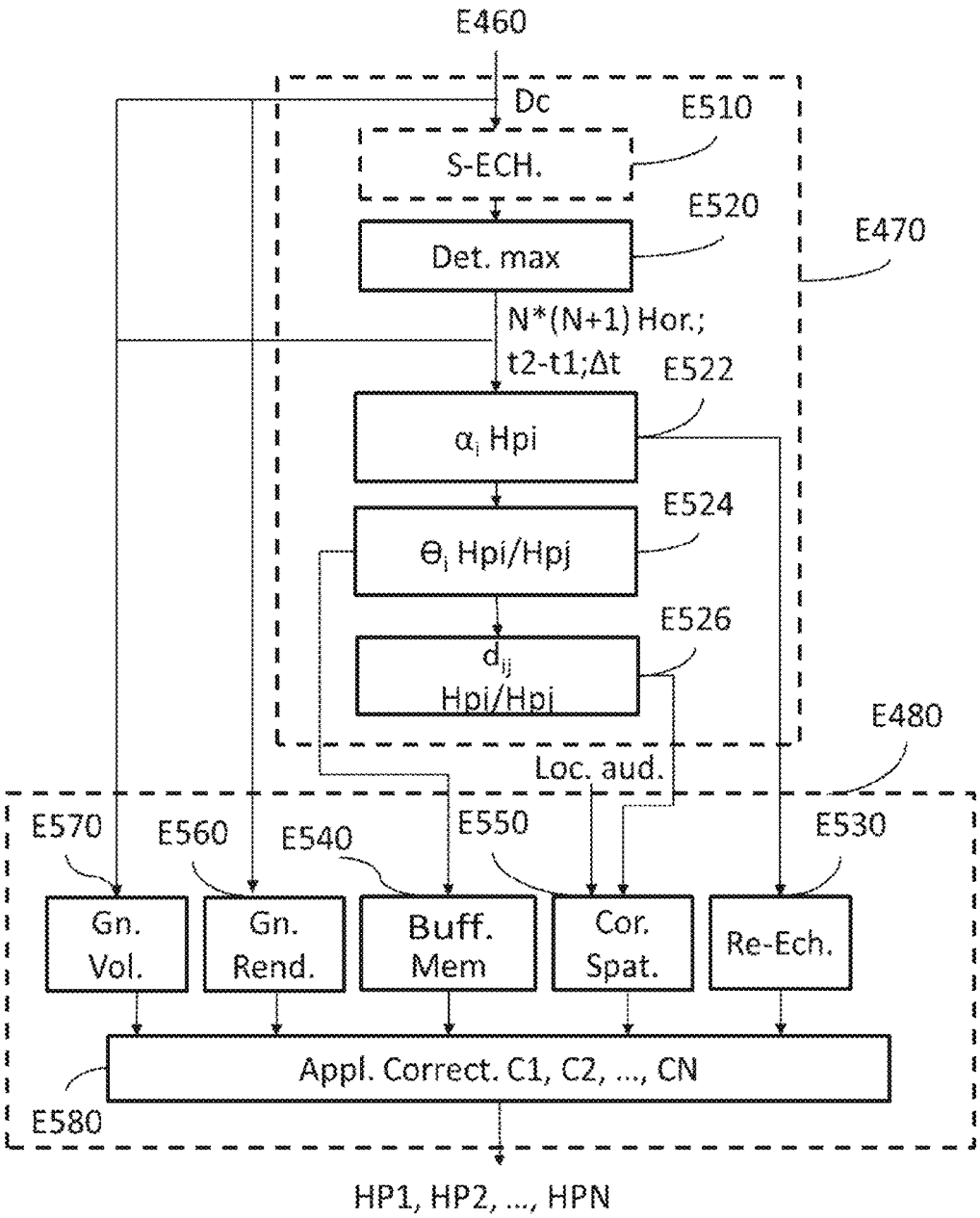
FIG. 5 illustrates, in detail, the analysis and correction steps implemented according to one embodiment of the calibration method according to the invention.

These steps E470 and E480 are detailed in FIG. 5 which is now described. Thus, the captured data received in E460 and resulting from the capture steps E410 to E460 are transformed into impulse responses by convolution with the inverse signal, as described above with reference to FIG. 3. Since the overall operation may be cumbersome, it may be preferable to carry it out by using an analysis window.

Once this operation has been carried out, a signal is obtained comprising a series of impulse responses corresponding to the various speakers according to the order of rendering of the calibration signal of the capture procedure.

In step E520, a peak detection is determined on the impulse responses thus obtained. The times corresponding to the maximum of the impulse responses are kept as timestamp data. The detection step is in fact a detection of multiple peaks. The approach used here as one embodiment consists of discovering each local maximum defined by the transition from a positive slope to a negative slope. All of these local maxima are then sorted in descending order and the first N*(N+1) are retained.

This approach is simple but may lead to errors if an impulse response has a maximum that is lower than noise. In order for these particular cases to be detected, a peak detection threshold is defined.

In addition, for each impulse response, secondary peaks may be present and higher than the primary peak of another response. To avoid this, a minimum duration is defined between two peaks detected on the signal.

N*(N+1) timestamp data are thus obtained.

In step E522, for each of the speakers HPi of the set, the drift $\alpha_i$ of its clock with respect to that of the processing server is determined.

The captured data used are the N+1 timestamp data measured when the calibration microphone is placed in front of the speaker HPi. These timestamp data are denoted by $T_i^k$ with $k \in [0, \ldots, N+1[$, and the theoretical time elapsed between two measurements of the same speaker HPi: t2−t1.

If the theoretical time elapsed between the signal played by the speaker HPi at time t1 and at time t2 is equal to Nδ with δ=Δt the constant theoretical time elapsed between two renderings of the calibration signal on two adjacent speakers of the loop E430 to E435, it is possible to estimate the drift of the speaker HPi with respect to the server according to the following equation (EQ5):

$$\propto i = \frac{T_i^N - T_i^0}{N\delta}$$

This theoretical time t2−t1 is set before initiating the calibration and it may be chosen according to the desired precision in terms of estimating the various heterogeneity factors.

Specifically, the precision in the estimation the various clock coordination and mapping parameters is mainly linked to the precision in the estimation of the timestamp data. The detection of peaks on the impulse responses means a temporal precision corresponding to one sample, i.e. approximately 20 μs for a sampling frequency at 48 kHz. Beyond the fact that better precision may be desirable, it is above all the estimation of the clock drift which is affected. Specifically, small drift values are to be expected, of the order of 10 ppm. If the theoretical duration between the two timestamp data being used to estimate the drift in the above equation EQ5 is equal to 1 s, an error of one sample in the estimation of the timestamp data results in an error of about 20 ppm.

A first solution for decreasing this error is to increase the duration δ between the renderings of the calibration signal. If this duration is such that the duration between the two renderings of the calibration signal on the same speaker (t2–t1) being used to estimate the drift is at least equal to 20 s, the estimation error becomes smaller than 1 ppm. This solution involves significantly increasing the total duration of the acoustic calibration, which is not always possible.

A second solution consists in upsampling the impulse responses in a step E510 shown in FIG. 5, in order to increase the precision of the detection of peaks. Upsampling by an integer factor P is a conventional method in signal processing. P−1 zeros are first inserted between the samples of the signal to be upsampled. The resulting signal is then filtered by a low-pass filter. In one exemplary embodiment, this low-pass filter is a 100-order "Butterworth" filter as described in the document entitled "Discrete-Time Signal Processing" by the authors Oppenheim, A. V., Schafer, R. W., and Buck, J. R. and published in Prentice Hall, second edition in 1999. This low-pass filter has a cut-off frequency set at the Nyquist frequency Fs/2, with Fs the sampling frequency of the initial signal. This technique makes it possible to decrease the errors in the estimation of the timestamp data, and therefore of the calibration parameters, without increasing the measurement duration. However, upsampling leads to an increase in the calculation time.

In practice, a mixture of the two solutions (increasing the time interval δ and upsampling) is used. The time between the signals being used to estimate the drift is increased to about 8 s and an upsampling by a factor of 10 is implemented.

Thus, the drift of each speaker is estimated in E522.

On the basis of the timestamp data obtained in E520 and the theoretical time elapsed between the calibration signal played by speaker i and the signal played by the speaker 0, equal to i (N+1)δ, it is possible to define a relative latency $\theta_{i,0}$ between these two speakers and equal to (EQ6):

$$\theta_{i,0} = \frac{T_i^0}{\alpha_i} - \frac{T_0^0}{\alpha_0} - i(N+1)\delta$$

Defining the relative latencies with respect to the first speaker is arbitrary and may lead to negative values. In order to achieve only positive values and thus have the delay of each speaker with respect to that which is furthest ahead, the following is calculated (EQ7):

All of the relative latencies between speakers taken in pairs are thus obtained, in step E524. When all of the clock drifts and all of the relative latencies are known, the distances between the speakers may be estimated in step E526. According to the calibration procedure described in FIG. 4, when the microphone is placed in front of the speaker i, the other speakers play the calibration signal in a circular order. For k∈[0 . . . N[, the theoretical time elapsed between the timestamp data $T_i^0$ and $T_i^k$ is equal to k. The distance between the speaker i and another speaker j is estimated according to the equation (EQ8):

$$\begin{cases} j = (i+k)(\mathrm{mod}N) \\ t_{ij} = \left(\frac{T_i^k}{\alpha_j} - \theta_j\right) - \left(\frac{T_i^0}{\alpha_i} - \theta_i\right) - k\delta \\ d_{ij} = t_{ij}c \end{cases}$$

with c the speed of sound in air.

The value tij represents the propagation time of a sound wave between the two speakers. For each pair (i, j) of speakers, the distance dij is estimated twice. The average of these two values is used, i.e. (EQ9):

$$\overline{d_{ij}} = \overline{d_{ji}} = \frac{1}{2}(d_{ij} + d_{ji})$$

to build a symmetric square matrix D the elements of which are the squares of the distances between each pair of speakers:

$$\overline{d}_{ij}^2$$
$$(i, j)\epsilon[0 \ldots N[^2$$

for.

After this detailed analysis step E470, the calibration method implements a correction step E480 which is now detailed in order to homogenize the heterogeneous distributed audio system.

In step E530, a correction of the tuning heterogeneity factor, corresponding to the clock drift of a speaker with respect to the server, is calculated. The clock drift between a speaker and the server is not corrected by directly modifying the clock of the sound card of the corresponding speaker or of the wireless speaker, mainly because the access to this clock is not possible in this context of heterogeneous distributed audio. The correction is here applied to the audio data by the client module controlling the speaker. Specifically, the audio samples are delivered to the sound card or to the wireless speaker by a client module as described with reference to FIG. 1. To correct this drift, processing on the sampling frequency is performed. Specifically, if the acoustic calibration shows that the data are being played too fast, the client module has to slow them down.

Thus, for a speaker HPi, the drift $\alpha_i$ of which with respect to the server has been estimated in step E522, the new sampling frequency (FSRC) to be applied to the audio samples is calculated in E530 and is equal to $F_s/\alpha_i$. This new sampling frequency is given to the sampling frequency converter SRC ("sample rate converter") of the client module Ci. In step E570, this correction is applied by the client Ci via its converter SRC which implements, in this embodiment, a linear interpolation between the samples and takes as parameter only the new sampling frequency FSRC as defined above. This resampling is performed in E580 by each of the clients C1, C2, . . . , CN corresponding to the speakers HP1, HP2, . . . , HPN in order to correct the tuning heterogeneity factor of the various speakers.

In the same way as the correction of the clock drift and therefore of the tuning heterogeneity factor, the correction of the synchronization heterogeneity factor, due to the relative latencies between the speakers, is carried out by the client module of the speaker affected by the correction. The latencies $\theta_i$ calculated in E524 represent the delay of each speaker with respect to that which is furthest ahead. In practice, to correct this latency, it is not possible to advance the playback of devices that are behind. It is therefore necessary to delay the playback of the speakers that are in advance of that which is furthest behind. To do this, the playback is delayed by adding a buffer. The duration of this buffer $\phi_1$ for the speaker is obtained in E540 on the basis of the latencies $\theta_i$ according to the equation (EQ10):

$$\Phi_i = \max_{i\in(0\ldots N)}(\theta_i) - \theta_i$$

This buffer value is transmitted to the client module C of the speaker HPi in E580 so that the audio data received from the server are not sent directly to the sound card or to the wireless speaker but after a delay corresponding to the size of the buffer thus determined. The synchronization of all of the speakers may then be achieved by adding $\Phi_i$ to the size of the buffer of each client Ci.

To correct the heterogeneity factor of the sound rendering of the speakers, step E560 retrieves the impulse responses of the speakers which have been generated and retained from the captured data. The amplitude of its Fourier transform constitutes the response of the speaker as a function of the frequency. It allows step E560 to calculate the energy in each frequency band in question. The calibration process, described in FIG. 4, produces two impulse responses per speaker. The estimated energy values may therefore be averaged over these two measurements. The obtained energy value is then averaged over each frequency band in order to obtain an equalization correction in the form of a gain to be provided to each speaker in each band.

These equalization gains may be applied at the server level or may be sent, in E580, to the various clients in order to equalize the audio signal to be transmitted to the speakers and thus homogenize the sound rendering of the speakers.

To now correct the sound volume of the speakers, in step E570 and in one embodiment of this step, only an overall volume equalization is performed, i.e. over a single band taking into account the entirety of the audible spectrum. To avoid saturating the speakers, the equalization applies a gain reduction to each speaker in order to adjust its volume to the lowest among them.

For this, the client modules of the corresponding speakers have a volume option expressed as a percentage. If Ei is the overall energy estimated for each speaker i, its volume VI (in %) is calculated according to the following equation (EQ11):

$$V_i = 100\frac{\min_{i\in[0\ldots N]}(E_i)}{E_i}$$

This volume correction is thus sent, in E580, to the corresponding client modules so that they apply this volume correction by applying a suitable gain.

The acoustic calibration produces the matrix D of the squares of the distances, in step E526, between each pair of speakers. In step E550, a mapping of the speakers is first produced on the basis of these data, in order to then be able to apply a spatial correction to adapt the optimum listening point to a given position of a listener.

An approach based on Euclidean distance matrices (EDMs) may therefore be applied.

The MDS (for "multidimensional scaling") algorithm may be applied. It uses the rank properties of the EDMs to estimate the Cartesian coordinates of the speakers in an arbitrary reference frame as described in the document entitled "Euclidean distance matrices: Essential theory, algorithms, and applications" by the authors Dokmanic, I., Parhizkar, R., Ranieri, J., and Vetterdi, M published in *IEEE Signal Processing Magazine,* 32(6): 12-30 in 2015.

In particular, the conventional MDS defines the center of the reference frame at the barycenter of the speakers. However, an important assumption must hold true in order to be able to apply the MDS: the matrix D must be a Euclidean distance matrix.

According to the authors, this assumption is true if the Gram matrix obtained after centering the matrix D is positive semi-definite, i.e. its eigenvalues are greater than or equal to 0. It turns out that this condition is not always met in the application case described above because of the placement of the measurement microphone or errors in the estimation of the distances between the speakers.

If the matrix D is not an EDM, another approach is needed for the mapping. For example, the ACD (for "alternate coordinate descent") algorithm. This method consists of a gradient descent on each coordinate sought in order to minimize the error between the matrix D as measured and as estimated. This method is described in the document entitled "*Euclidean Distance Matrices: Properties, Algorithms and Applications*" by the author Parhizkar, R, published in his PhD thesis, École Polytechnique Fédérale de Lausanne (Swiss Federal Institute of Technology Lausanne), Switzerland in 2013. While this algorithm converges quickly, it is still more cumbersome than the conventional MDS. For this reason, in one embodiment of the invention, the mapping algorithm carried out begins with the application of the MDS method and applies the ACD method only once it has been verified that the matrix of the measured distances is not an EDM.

The mapping returns the positions of all of the speakers in the form of Cartesian coordinates in an arbitrary reference frame. The application of a spatial correction of the system adapted to the position of a listener requires knowledge of this position in the same reference frame. It may be obtained by means of localization methods based on microphone antennas or on a plurality of microphones distributed through the room. Other approaches may be based on video localization. Determining the position of the listener is not the object of this invention. It is received by the server in step E550 in order to determine the spatial corrections to be made to the various speakers.

A first spatial correction method consists in virtually moving all of the speakers into a circle, the center of which is the listener. The distance between the latter and each speaker is calculated. The radius of the circle of speakers is the greatest of these distances. The virtual movement is finally achieved by applying a delay and a gain to each speaker the distance of which to the listener is smaller than the radius of the circle.

This method already contributes greatly to improving the immersion of the listener, but is not sufficient if the actual positions of the speakers are too far away from the optimal positions defined in the standard (ITU, 2012) cited above.

In this case, an angular adaptation that virtually relocates the speakers to the optimal positions may be used. This functionality is, for example, present in the MPEG-H codec and described in the standard (ISO/IEC 23008-3, 2015).

These delay, gain or angle parameters determined in this step E550 are sent to the corresponding client modules so that they implement these corrections in E570 in order to correct the heterogeneity factor relating to the mapping.

Thus, carrying out a calibration method according to the invention makes it possible, with a single measurement, to have access to all of the parameters required for the homogenization of a heterogeneous distributed audio system. This overall calibration is important since the parameters are dependent on one another, namely the relative latency between two speakers is dependent on their respective clock drift, and the estimate of the distance between two speakers is dependent on their relative latency and their respective drift.

The method presented here by the audio rendering system may then make the necessary corrections:

- tuning by way of sampling frequency conversion;
- synchronization by way of buffer adaptation;
- overall equalization of the speakers by adjusting their volume;
- equalization per frequency band in order to homogenize the sound rendering;
- spatial configuration of the system by way of a mapping algorithm.

One or more of these factors may thus be corrected.

Although the present disclosure has been described with reference to one or more examples, workers skilled in the art will recognize that changes may be made in form and detail without departing from the scope of the disclosure and/or the appended claims.

The invention claimed is:

1. A method for calibrating a distributed audio rendering system, comprising a set of N heterogeneous speakers controlled by a server, the method comprising the following steps:

a) placing a microphone in front of a first speaker of the set;

b) capturing, by using said microphone, a calibration signal sent to the first speaker at a first time and rendered by this speaker;

c) capturing, by using said microphone, the calibration signal sent alternately with a known time shift to the N−1 other speakers of the set and rendered by these N−1 speakers;

d) capturing, by using said microphone, the calibration signal sent to the first speaker at a second time and rendered again by this speaker;

e) iterating steps a) to d) for the N−1 other speakers of the set;

f) determining a plurality of heterogeneity factors to be corrected for the set of the N speakers by analyzing the calibration signals thus captured, including multiple detections of peaks of impulse responses obtained from the captured calibration signals, a maximum peak being detected by taking into account an exceedance threshold for the detected peak and a minimum duration between two detected peaks, in order to obtain N*(N+1) timestamp data; and g) correcting the determined heterogeneity factors.

2. The method as claimed in claim 1, wherein the heterogeneity factors form part of a list from among:

- a clock coordination of the speakers comprising a synchronization and a tuning of the speakers;
- a sound volume of the speakers;
- a sound rendering of the speakers; and
- a mapping of the speakers.

3. The method as claimed in claim 1, wherein the microphone is in a calibration device previously tuned with the server.

4. The method as claimed in claim 1, wherein the impulse responses of the captured calibration signals are obtained from a convolution of the captured calibration signals with an inverse calibration signal.

5. The method as claimed in claim 1, wherein an upsampling is implemented on the captured calibration signals before the detection of peaks.

6. The method as claimed in claim 1, wherein an estimate of a clock drift of a speaker of the set with respect to a clock of the server is made on the basis of the timestamp data obtained for the calibration signals sent at the first and at the second time and of the time elapsed between these two times.

7. The method as claimed in claim 6, wherein an estimate of the relative latency between the speakers of the set, taken in pairs, is made on the basis of the obtained timestamp data and the estimated drifts.

8. The method as claimed in claim 7, wherein an estimate of the distance between the speakers of the set, taken in pairs, is made on the basis of the obtained timestamp data, the estimated relative latencies and the estimated drifts.

9. The method as claimed in claim 6, wherein a heterogeneity factor relating to a tuning of the speakers of the set is corrected by resampling the audio signals intended for the corresponding speakers, according to a frequency dependent on the estimated clock drifts of the speakers with the clock of the server.

10. The method as claimed in claim 7, wherein a heterogeneity factor relating to a synchronization of the speakers of the set is corrected by adding a buffer, for the transmission of the audio signals intended for the corresponding speakers, the duration of which is dependent on the estimated latencies of the speakers.

11. The method as claimed in claim 8, wherein a heterogeneity factor relating to a mapping of the speakers of the set is corrected by applying a spatial correction to the corresponding speakers, according to at least one delay dependent on the estimated distances between the speakers and a given position of a listener.

12. The method as claimed in claim 1, wherein a heterogeneity factor relating to the sound rendering and/or a heterogeneity factor relating to the sound volume of the speakers of the set is corrected by equalizing the audio signals intended for the corresponding speakers, according to gains dependent on the captured impulse responses of the speakers.

13. A system for calibrating a distributed audio rendering system, comprising a set of N heterogeneous speakers controlled by client modules controlled by a server, the calibration system comprising:

a microphone which, placed in front of a first speaker of the set, is able to capture a calibration signal sent to the first speaker at a first time and rendered by this speaker, to capture the calibration signal sent alternately with a known time shift to the N−1 other speakers of the set and rendered by these N−1 speakers, to capture the calibration signal sent to the first speaker at a second time and rendered by this speaker and to iterate the capture operations for the N−1 other speakers of the set, and a processing server which is configured to collect the captured calibration signals, analyze the captured and collected calibration signals, including multiple detections of peaks of impulse responses obtained from the captured calibration signals, a maximum peak being detected by taking into account an exceedance threshold for the detected peak and a minimum duration between two detected peaks, in order to obtain N*(N+1) timestamp data, in order to determine a plurality of heterogeneity factors to be corrected and calculate corrections for the determined heterogeneity factors and to transmit them to the various client modules of the corresponding speakers in order to apply the calculated corrections.

14. The calibration system as claimed in claim 13, wherein the microphone is integrated into a terminal.

15. A non-transitory computer-readable storage medium on which there is recorded a computer program comprising code instructions which when executed by a processor of a calibration system, configure the calibration system to calibrate a distributed audio rendering system, comprising a set of N heterogeneous speakers controlled by a server:

a) capturing, by using a microphone placed in front of a first speaker of the set, a calibration signal sent to the first speaker at a first time and rendered by this speaker;

b) capturing, by using said microphone, the calibration signal sent alternately with a known time shift to the N−1 other speakers of the set and rendered by these N−1 speakers;

c) capturing, by using said microphone, the calibration signal sent to the first speaker at a second time and rendered again by this speaker;

d) iterating steps a) to c) for the N−1 other speakers of the set;

e) determining a plurality of heterogeneity factors to be corrected for the set of the N speakers by analyzing the calibration signals thus captured including multiple detections of peaks of impulse responses obtained from the captured calibration signals, a maximum peak being detected by taking into account an exceedance threshold for the detected peak and a minimum duration between two detected peaks, in order to obtain N*(N+1) timestamp data;

f) correcting the determined heterogeneity factors.

* * * * *